United States Patent [19]

Kawase et al.

[11] Patent Number: 4,831,847

[45] Date of Patent: May 23, 1989

[54] KNITTING MACHINE PARTS

[75] Inventors: Shinji Kawase; Toshiro Izumi, both of Hyogo, Japan

[73] Assignee: Precision Fukuhara Works, Ltd., Hyogo, Japan

[21] Appl. No.: 167,520

[22] Filed: Mar. 14, 1988

[30] Foreign Application Priority Data

May 6, 1987 [JP] Japan ..... 62-67767[U]

[51] Int. Cl.[4] ..... D04B 35/04; D04B 15/06

[52] U.S. Cl. ..... 66/123; 66/107

[58] Field of Search ..... 66/8, 104, 107, 110, 66/123, 124, 217

[56] References Cited

U.S. PATENT DOCUMENTS

| | | | |
|---|---|---|---|
| 363,153 | 5/1887 | Malpass, Jr. | 66/123 |
| 546,984 | 10/1895 | Adgate | 66/123 |
| 567,931 | 9/1896 | Woodward | 66/123 |
| 664,808 | 12/1900 | Dodge | 66/123 |
| 822,401 | 6/1906 | Sturtevant | 66/123 |
| 1,681,512 | 8/1928 | Beyer | 66/123 X |
| 2,247,611 | 7/1941 | Frischman | 66/110 |
| 2,269,288 | 1/1942 | Saftlas et al. | 66/123 X |
| 3,699,784 | 10/1972 | Berentzen | 66/123 |
| 3,712,083 | 1/1973 | Slof et al. | 66/123 |
| 3,842,626 | 10/1974 | Stivers et al. | 66/123 X |
| 3,964,274 | 6/1976 | Stivers et al. | 66/123 |
| 4,417,454 | 11/1983 | Berentzem | 66/123 |
| 4,434,628 | 3/1984 | Tsuzuki | 66/123 |

FOREIGN PATENT DOCUMENTS

| | | | |
|---|---|---|---|
| 1959494 | 6/1970 | Fed. Rep. of Germany | 66/123 |

*Primary Examiner*—Wm. Carter Reynolds

*Attorney, Agent, or Firm*—Bell, Seltzer, Park & Gibson

[57] ABSTRACT

The wear life of knitting machine instrumentalities, such as knitting needles, sinkers, or the like, is increased by providing a reinforcing wear-resistant plate member on the operating butt portion thereof to effectively increase the thickness of the operating butt portion. The wear-resistant plate member includes a cam engaging edge extending along the cam engaging edge of the operating butt portion with the cam engaging edge being inclined at an angle corresponding to the inclined angle of the operating cams of the knitting machine which it is adapted to engage. A beveled edge extends along the junction of the cam engaging edge and the face of the adjacent operating butt portion to form a groove defining an oil retaining sump between the plate member and the operating butt portion for temporarily retaining lubricant therein and for providing lubrication between the operating butt portion and the operating cams.

7 Claims, 1 Drawing Sheet

KNITTING MACHINE PARTS

FIELD OF THE INVENTION

This invention relates generally to knitting machine parts or instrumentalities, such as knitting needles, sinkers, or the like which include an operating butt portion for engagement with operating cams of the knitting machine, and more particularly to increasing the wear life by reinforcing the operating butt portion with a wear-resistant plate member providing an oil retaining sump between the plate member and the operating butt portion for lubricating the engagement of the operating butt portion with the operating cams.

BACKGROUND OF THE INVENTION

Knitting machine instrumentalities, such as knitting needles, sinkers, or the like, are normally provided with operating butt portions to be engaged by corresponding operating cams arranged around the knitting machine for imparting longitudinal movement to the instrumentalities during the knitting process. These operating butt portions are normally formed simultaneously with the remainder of the knitting instrumentality as it is punched out of a steel plate. Accordingly, the thickness of the operating butt is the same as the thickness of the remaining parts of the instrumentality. Contact of the relatively thin operating butt with the operating cams during the formation of stitches tends to rapidly wear the thin operating butt. When the operating butt becomes worn with continued use, the operation of other portions of the knitting instrumentality is affected even though the other portions are not worn. Worn operating butts can thus interfere with the formation of perfectly knit fabric and may also cause improper operation of other parts of the knitting machine. Knitting instrumentalities which have operating butts that wear quickly have a short life and must be replaced, thereby adding to the cost of producing knit fabric.

SUMMARY OF THE INVENTION

With the foregoing in mind, it is an object of the present invention to provide knitting machine instrumentalities with operating butts which resist wear over long periods of use.

In accordance with the present invention, the knitting machine instrumentality operating butts are provided with a reinforcing wear-resistant plate member fixed to one or both faces of the operating butt portion. The thickness of the reinforcing plate member will differ, in accordance with the diameter and gauge (number of needles per inch) of the cylinder of the knitting machine. When the reinforcing plate member is provided on a needle and attached to only one face of the operating butt portion, the thickness will be a dimension which is somewhat less than the dimension which is obtained by subtracting the needle thickness from the distance between groove spaces of the cylinder. When the reinforcing plate member is provided and attached to both faces of the operating butt portion, the thickness thereof should be about one-half of the thickness of the reinforcing plate member which is attached to only one face of the operating butt portion.

The width of the reinforcing plate member in the projecting direction of the operating butt is not particularly limited, except that it should be less than the length of the operating butt projecting from the stem of the knitting needle. The material of which the reinforcing plate member is formed is not particularly limited as various types of metals and plastic materials may be utilized with the reinforcing plate member preferably being formed of wear-resistant steel. It is preferred that the reinforcing plate member be welded to the operating butt, it being understood that the reinforcing plate member may be attached to the operating butt by riveting, inserting, or the like. It is also preferred that the welding of the reinforcing plate member to the operating butt be accomplished by several spot welds.

The wear-resistant plate member has one face fixed to the operating butt portion and serves to effectively increase the thickness of the operating butt portion. The wear-resistant plate member include a cam engaging edge which extends along the operating butt portion with the cam engaging edge being disposed at an angle which generally corresponds to the angle of the operating cams of the knitting machine. A beveled or curved edge extends along the juncture of the cam engaging edge of the plate member and along the adjacent edge of the operating butt to define an oil retaining sump between the plate member and the operating butt butt portion with the operating cams of the knitting machine and to thereby increase the wear life of the operating butt.

BRIEF DESCRIPTION OF THE DRAWINGS

Other objects and advantages will appear as the description proceeds when taken in connection with the accompanying drawings, in which.

DESCRIPTION OF THE PREFERRED EMBODIMENT

Figure 1:
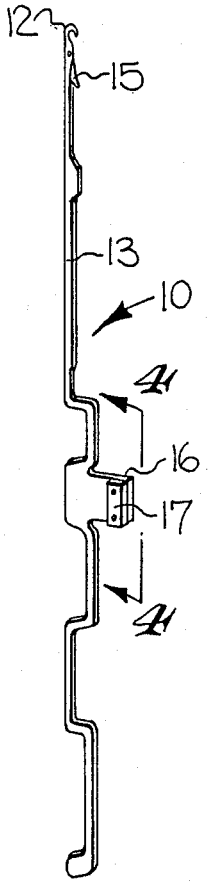
FIG. 1 is a perspective view of a knitting needle with a wear-resistant reinforcing plate member fixed to one face of the operating butt portion in accordance with one embodiment of the present invention.

A first embodiment of the present invention is illustrated in FIG. 1 wherein the knitting machine instrumentality is illustrated as a latch needle, broadly indicated at 10, of a type normally used in circular knitting machines. The latch needle 10 is provided with an elongated stem 13 having a hook 12 at the upper end thereof. A latch is supported for pivotal movement into and out of engagement with the hook 12 during the conventional knitting operation. The stem 13 can be of any conventional type normally used in knitting needles and is illustrated as being provided with a meander form for relieving impact forces. An operating butt 16 is integrally formed with the stem 13 and extends outwardly therefrom for engagement with corresponding operating cams provided in the knitting machine to impart longitudinal movement to the latch needle 10 in the usual manner.

Figure 2:
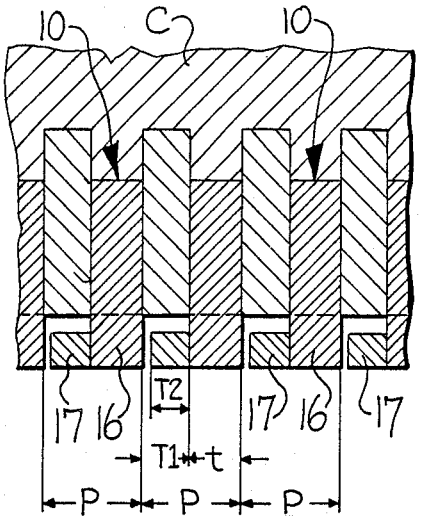
FIG. 2 is a greatly enlarged fragmentary sectional plan view illustrating a portion of the needle cylinder and showing reinforcing plate members fixed on one face of the operating butts of adjacent knitting needles mounted for vertical sliding movement in needle cylinder grooves.

In accordance with the present invention, reinforcing means is associated with the operating butt portion 16 for increasing the wear life of the butt portion. The reinforcing means includes a wear-resistant plate member 17 having one face fixed to one face of the operating butt portion 16 and serving to effectively increase the thickness of the operating butt portion 16. The reinforcing plate member 17 will vary in thickness in accordance with the diameter and the gauge (number of needles per inch) of the knitting machine cylinder C. When the reinforcing plate member 17 is attached to only one face of the operating butt 16, as shown in FIG. 2, the thickness, as indicated at $T_2$, is slightly less than the dimension $T_1$ which is determined by subtracting the needle thickness dimension t from the overall dimension P of one space of the groove of the needle cylinder C. For example, the needle thickness t of a needle 10 in a 16 inch, 22 gauge circular knitting machine is 0.52 mm, and the thickness of the reinforcing plate 17 will also be 0.52 mm.

Figure 3:
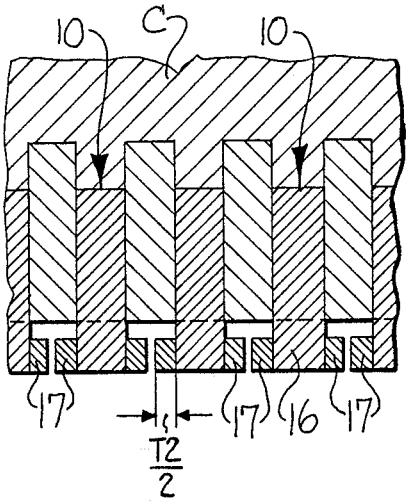
FIG. 3 is a view similar to FIG. 2 but illustrating reinforcing plate members fixed on both faces of the operating butt portions of the knitting needles.

When a reinforcing plate member 17 is fixed on both faces of the butt portion 16, as illustrated in FIG. 3, the thickness of each of the plate members 17 is about one-half of the thickness $T_2$, as indicated in FIG. 3. The width of the reinforcing plate member 17 in the projecting direction of the butt 16 must be slightly less than the height of the butt 16 projecting from the needle cylinder grooves. Steel is utilized as the reinforcing plate member 17 in the embodiment illustrated, while it is to be understood that other metals or nonmetals may be employed as the wear-resistant plate member 17. The reinforcing plate members 17 may be attached to one or both faces of the operating butts 16 by laser spot welding in spaced-apart locations, as illustrated in FIG. 1. Also, other methods of attaching the reinforcing plate member 17 to the operating butt 16 may be employed, such as riveting or the like.

Figure 4:
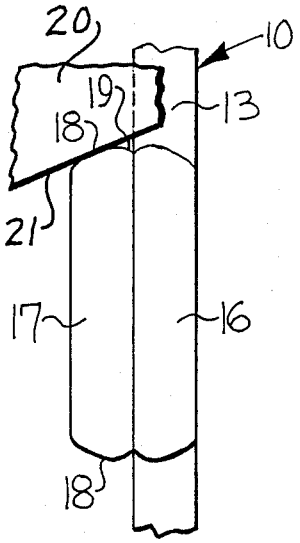
FIG. 4 is an enlarged fragmentary elevational view looking inwardly toward the operating butt portion of the knitting needle, in the direction of the dash-dot line 4—4 in FIG. 1; and showing a fragmentary portion of an operating cam with the lower inclined edge being engaged by the corresponding inclined upper edge of the reinforcing plate member.

Wear of the operating butts 16 is increased by the braking action of the engagement of the operating cams with the butt, particularly at the points where reverse movement of the needle is imparted by the operating cams. In order to reduce this braking action, and to thereby reduce wear, the upper and lower cam engaging edges of the reinforcing plate 17, as well as the operating butt 16, are inclined at an angle by including arching portions 18 which substantially correspond to the inclined angles of the operating cams against which these edges are adapted to engage. A fragmentary portion of a conventional operating cam is shown at 20 in FIG. 4, with an inclined lower edge 21. The inclined cam engaging edges 18 provide an enlarged contacting area with the inclined edge 21 of the operating cam 20 so that smooth knitting needle movement is achieved along the cam track. Also, beveled or curved edges extend along the juncture of the cam engaging edge 18 and the adjacent face of the reinforcing plate member 17, as well as along the adjacent edge of the operating butt portion 16 to form a groove 19 which defines an oil retaining sump between the plate member 17 and the operating butt portion 16. As oil is supplied to the needles and the butt portion 16, the oil penetrates between the fitting surfaces of the reinforcing plate member 17 and the operating butt portion 16 and is temporarily held in reserve in the oil sump grooves 19 so that it is gradually deposited on the operating cams to provide a lubricated sliding surface and to diminish wear of the butt.

Figure 5:
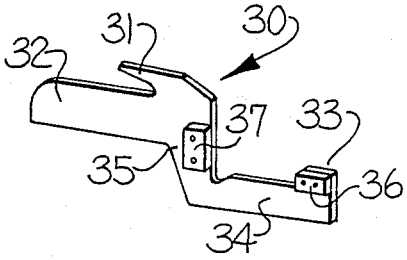
FIG. 5 is a perspective view of a sinker and illustrating embodiments of the reinforcing plate members of the present invention applied to the operating butt portions thereof.

The operating butt reinforcing means of the present invention is illustrated in FIG. 5 as being applied to a conventional type of sinker 30 used in a circular knitting machine. The sinker 30 is provided on its forward portion with a stitch drawing ledge 32 and a neb 31. The rear portion 34 includes an upstanding operating butt 33 which is adapted to make contact with corresponding control cams of the knitting machine. An intermediate portion 35 of the sinker is also provided with a vertical operating butt portion. A reinforcing plate member 36 is fixed to the operating butt 33 while a reinforcing plate member 37 is fixed to the vertical operating butt portion of the intermediate section 35. If desired, pairs of reinforcing plate members 36, 37 may be fixed to opposite sides of the corresponding portions of the sinker 30.

In order to test the effectiveness of the reinforcing plate members of the present invention, a circular knitting machine was subjected to a no-load test in which the machine ran for about 240 hours (1,000,000 revolutions), without forming knit fabric. The needle cylinder was supplied with needles of the conventional type with the operating butt being thin and of the same thickness as the stem, and with knitting needles supplied with the reinforcing plate member of the present invention on the operating butt portions thereof. Upon completion of the test operation, the amount of wear of the respective butts was examined. The results indicated that while a wear of 0.06 mm (average value) occurred in the conventional needles, only an average wear of 0.003 mm occurred in the butts of the needles equipped with the reinforcing plate members in accordance with the present invention. Thus, the needles of the present invention with the reinforcing plate members attached to the operating butts thereof had significantly less wear than the conventional needles without the reinforcing plate members attached thereto.

In addition to the thickening of the operating butts, the angular inclination of the butts is believed to also contribute to the improved wear resistance of the needles, as well as the retention of the oil in the grooves defining oil sumps in the area between the reinforcing plate member and the operating butt portion.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a knitting machine instrumentality, such as a knitting needle, sinker, or the like, including an operating butt portion for engagement with operating cams of the knitting machine, the combination therewith of reinforcing means associated with said operating butt portion for increasing the wear life of said operating butt portion, said reinforcing means comprising a wear-resistant plate member having one face fixed to said operating butt portion and serving to effectively increase the thickness of said operating butt portion, said plate member including a cam engaging edge extending along said operating butt portion of said instrumentality, and a beveled edge extending along the juncture of said cam engaging edge and said one face of said plate member and forming a groove defining an oil retaining sump between said plate member and said operating butt portion for lubricating the engagement of said operating butt portion with said operating cams.

2. In a knitting machine instrumentality according to claim 1 wherein the thickness of said plate member is substantially the same as the thickness of said operating butt portion.

3. In a knitting machine instrumentality according to claim 1 wherein said wear-resistant plate member is fixed to one side of said operating butt portion, and including a second wear-resistant plate member fixed to the opposite side of said operating butt portion of said knitting machine instrumentality.

4. In a knitting machine instrumentality according to claim 3 wherein each of said wear-resistant plate members are substantially one-half of the thickness of said operating butt portion.

5. In a knitting machine instrumentality according to claim 1 wherein said wear-resistant plate member comprises wear-resistant metal.

6. In a knitting machine instrumentality according to claim 1 wherein said wear-resistant plate member is fixed to said operating butt portion by spot welding.

7. In a knitting machine instrumentality according to claim 1 wherein said cam engaging edge of said plate member is inclined at an angle corresponding to the inclined angle of the operating cams of the knitting machine which it is adapted to engage.

* * * * *